US007198499B2

(12) United States Patent
Kim et al.

(10) Patent No.: US 7,198,499 B2
(45) Date of Patent: Apr. 3, 2007

(54) LOW VOLTAGE ELECTRICITY DISTRIBUTION CIRCUIT

(76) Inventors: Kyung Tae Kim, 24971 Eaton La., Laguna Niguel, CA (US) 92677; Kyung Hoon Kim, 8705 La Salle St., Cypress, CA (US) 90630

( * ) Notice: Subject to any disclaimer, the term of this patent is extended or adjusted under 35 U.S.C. 154(b) by 125 days.

(21) Appl. No.: 10/509,563

(22) PCT Filed: Apr. 4, 2003

(86) PCT No.: PCT/IB03/01244

§ 371 (c)(1),
(2), (4) Date: Sep. 28, 2004

(87) PCT Pub. No.: WO03/084819

PCT Pub. Date: Oct. 16, 2003

(65) Prior Publication Data

US 2005/0202689 A1 Sep. 15, 2005

(30) Foreign Application Priority Data

Apr. 4, 2002 (NZ) ..... 518138

(51) Int. Cl.
*H01R 27/00* (2006.01)

(52) U.S. Cl. ..... 439/217

(58) Field of Classification Search ..... 439/217–218, 439/222–223, 650, 653
See application file for complete search history.

(56) References Cited

U.S. PATENT DOCUMENTS 1,933,358 A 10/1933 Almcrantz
2,313,452 A 3/1943 O'Brien
2,899,668 A 8/1959 Gribben
3,081,442 A 3/1963 Platz
3,466,453 A * 9/1969 Greenberg ..... 307/10.1
3,503,032 A 3/1970 Routh
3,529,274 A 9/1970 Routh
4,629,268 A 12/1986 Hiles
4,717,348 A * 1/1988 Mazzullo et al. ..... 439/76.1
5,007,848 A * 4/1991 Lee ..... 439/101
5,106,314 A 4/1992 Bael
5,368,490 A 11/1994 McKissick
5,520,555 A * 5/1996 Taylor ..... 439/680

(Continued)

FOREIGN PATENT DOCUMENTS

DE 10255315 6/2004

(Continued)

*Primary Examiner*—Tuyen T Nguyen
(74) *Attorney, Agent, or Firm*—Knobbe Martens Olson & Bear LLP

(57) ABSTRACT

The low voltage electricity distribution circuit of the present invention is an electrical outlet that includes a receptacle mounted to a recess including either a plurality of wires or a bus bar system. The receptacle has at least one continuously live power socket and at least one switched power socket disposed on it. Each of the power sockets is capable of receiving an appliance plug. The receptacle is movable along the recess to a different location to allow for appliances, for example lamps or computers, to be located at many different points along the wall. In other forms of the distribution circuit a stand-along unit that is fixed in place may be provided.

13 Claims, 15 Drawing Sheets

U.S. PATENT DOCUMENTS 5,582,520 A 12/1996 Doudon
5,582,522 A 12/1996 Johnson
5,603,621 A 2/1997 Elmouchi
6,086,397 A 7/2000 Chapman et al.
6,135,820 A 10/2000 Chiang
6,220,880 B1 4/2001 Lee et al.
6,227,883 B1 * 5/2001 Lee et al. ..... 439/106
6,315,617 B1 11/2001 Al-Sabah
6,328,584 B1 * 12/2001 Follett ..... 439/222

FOREIGN PATENT DOCUMENTS

| | | |
|---|---|---|
| EP | 1089398 | 9/2000 |
| GB | 2220803 A | 1/1990 |
| GB | 2344001 | 5/2000 |
| WO | WO 99/27618 | 6/1999 |

* cited by examiner

LOW VOLTAGE ELECTRICITY DISTRIBUTION CIRCUIT

RELATED APPLICATIONS

The present application is a U.S. national phase application under 35 U.S.C. § 371, based on PCT/IB03/01244, filed Oct. 16, 2003, and claims priority under applicable subsections of 35 U.S.C. §§ 119 and 365 to New Zealand Patent Application Number NZ 518318, filed Apr. 4, 2002.

BACKGROUND TO THE INVENTION

1. Field of the Invention

The present invention relates generally to low voltage electricity distribution circuits. In particular, the present invention relates to a power busbar system that provides electricity to a receptacle that has both a continuously live power socket and a switched power socket, where the receptacle is relocatable along the busbar system.

2. Summary of the Prior Art

It is known in the art to provide a busbar power system having numerous power sockets. It is also known in the art to provide moveable power points along a busbar, in order to move appliances and the like to different locations along the busbar and thus to a different area of a room.

GB2344001 of Electrak International Limited discloses a modular multi-busbar power track system, where each module of the system has a plurality of linear busbars within an elongate casing. In each module there is at least one access socket into which a tap-off plug may be inserted to electrically connect other elements to the power track system. This system does not allow for the access sockets to be movable.

WO99/27618 of The Wiremold Company discloses a power track in which electrical receptacles are mounted on. The track has a busbar power system that serves to power the contacts of the electrical receptacles. Any number of electrical receptacles can be releasably secured to the track, at any point along the track, by twisting a receptacle onto the track. The electrical receptacle disclosed provides for continuously live power sockets but no means in which to switch the power sockets.

DISCLOSURE OF INVENTION

The object of the invention is to provide an electricity distribution circuit which overcomes the abovementioned disadvantages or to at least provide the public with a useful choice.

Accordingly in a first aspect the present invention may be said to consist in a low voltage electricity distribution circuit, which supplies both switched and unswitched power from switched and unswitched power sources, comprising:

a moulding defining a recess, a first conductor that is connected in use to said unswitched power source a second conductor that is connected in use to said switched power source, and a third conductor that is connected in use to a neutral power source, said conductors configured with receiving means capable of receiving the pins of a plug connected to a load or electrical appliance, at least one receptacle that is mechanically and releasably engaged with said moulding, said receptacle having at least one live socket and one switched socket, each of said sockets being formed by a plurality of apertures extending through said receptacle, where said apertures are in registration with corresponding receiving means of said conductors, wherein in use, when said plug is inserted in said live socket said pins form an electrical connection with said first conductor and said neutral conductor such that said electrical appliance or load is continuously powered, and when said plug is inserted in said switched socket said pins form an electrical connection with said second conductor and said neutral conductor such that said electrical appliance or load is switchably powered.

In a second aspect the present invention may be said to consist in a standalone receptacle which supplies both switched and unswitched power from switched and unswitched power sources, comprising:

a first conductor that is connected in use to said unswitched power source, a second conductor that is connected in use to said switched power source, and a third conductor that is connected in use to a neutral power source, wherein said conductors are configured with receiving means capable of receiving the pins of a plug connected to a load or electrical appliance, said standalone receptacle having at least one live socket and one switched socket, each of said sockets being formed by a plurality of apertures extending through said receptacle, where said apertures are in registration with corresponding receiving means of said conductors, wherein in use, when said plug is inserted in said live socket said pins form an electrical connection with said first conductor and said neutral conductor such that said electrical appliance or load is continuously powered, and when said plug is inserted in said switched socket said pins form an electrical connection with said second conductor and said neutral conductor such that said electrical appliance or load is switchably powered.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF DRAWINGS

Preferred forms of the invention will be described with reference to the accompanying drawings in which.

DETAILED DESCRIPTION OF THE INVENTION

The low voltage electricity distribution circuit of the present invention is an electrical outlet that includes a receptacle that is mounted to a bus bar system. The bus bar system is preferably mounted within a housing that extends horizontally along the base of a wall or other desired location. The receptacle has at least one continuously live power socket and at least one switched power socket disposed on it. Each of the power sockets is capable of receiving an appliance plug. The receptacle is movable along the bus bar to a different location to allow for appliances, for example lamps or computers, to be located at many different points along the wall.

In other forms the distribution circuit may be a set of wires extending along housing and a receptacle including terminals that contact these wires. Furthermore, in yet other forms of the distribution circuit, a stand-along unit that is fixed in place may be provided.

Figure 1:
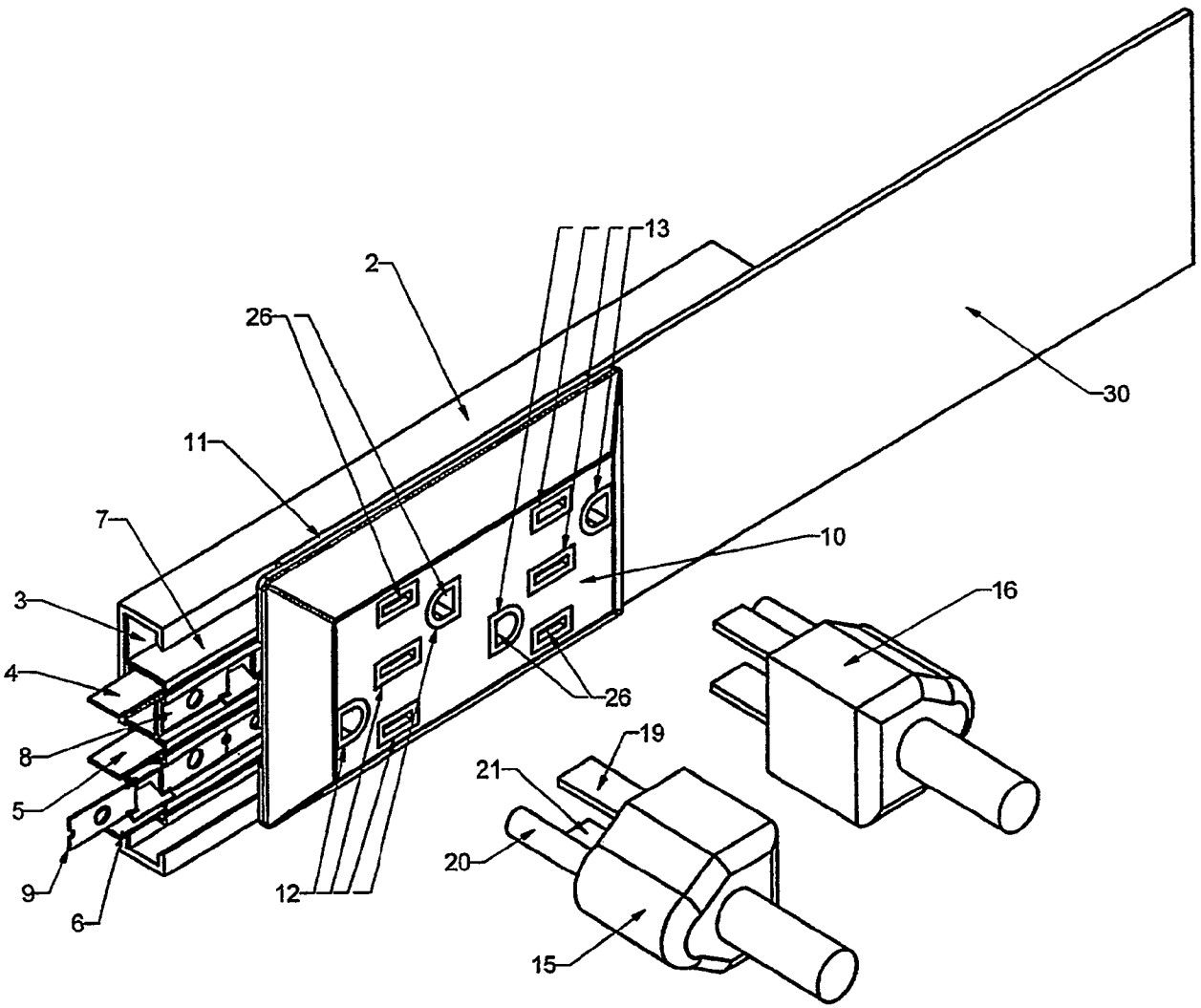
FIG. 1 is an illustration of the circuit of the present invention, where a receptacle having sockets is mounted to the power bus bar system and bus bar housing, and the sockets receive plugs connected to the electrical appliance or loads.

The preferred form of the electrical outlet apparatus of the present invention is shown in FIG. 1. A bus bar housing 2 is mounted on and extends along the base of a wall or at any other desired location on the wall. The housing 2 has a recess 3 extending within the entire length of the housing 2. Arranged within the recess 3 are a number of bus bars 4, 5, 6, 8, 9. In the preferred form of the present invention, the bus bars are made up of three electrically conductive contact strips 4, 5, 6 and two ground strips 8, 9 that extend along the recess 3. A bus bar insulator 7 encloses bus bars 4, 5, and 6. The bus bar insulator 7 also provides channels to mount or locate the ground bus bars 8 and 9. The bus bar insulator is made from an insulative and fire retardant plastic type material, but other appropriate materials may be used. In the preferred form, the upper contact strip 4 is a continuously powered ("live") bus bar, the centre contact strip 5 is a neutral bus bar, and the lower contact strip 6 is a switched bus (one that can be made live by the operation of a switch). Disposed above and below the neutral bus bar 5 are ground buses or strips 8, 9.

Fitted to the housing 2 and over the bus bar is a receptacle. The receptacle is made up of a faceplate 10 and back plate 11. The back plate 11 is affixed to the housing 2, and a faceplate 10 is fitted over the back plate 11.

Figure 6:
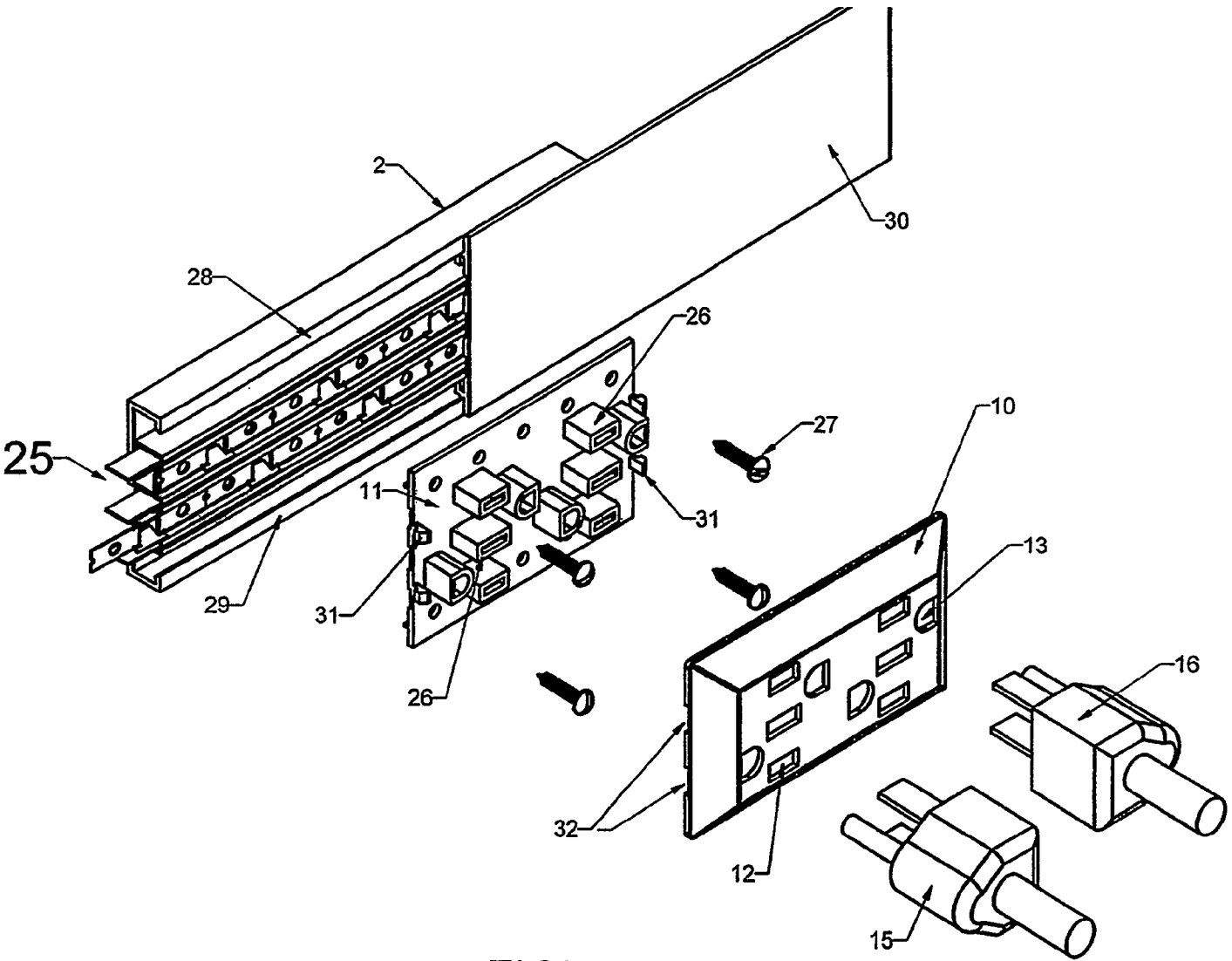
FIG. 6 is an exploded view of the circuit of the present invention showing each component of the outlet and how each component interconnects.

Referring to FIG. 6, hollow protrusions 26 in the shapes of the electric appliance plug pins protrude from the base of the back plate 11. When the faceplate 10 is attached to the back plate 11, the protrusions 26 fit into complimentary shaped apertures 12, 13 in the faceplate 10, but do not extend out from the faceplate surface. When the faceplate 10 and back plate 11 are affixed to one another the apertures 12, 13 and protrusions 26 form channels through the faceplate 10 and back plate 11. Sets of these channels form at least one socket that is capable of accommodating at least one standard two or three-pin electric appliance plug 15, 16. The channels extend to the bus bars thereby allowing the pins of a plug, when inserted in a socket, to meet with the bus bars forming an electrical contact between the bus bars and the plug pins.

Figure 2:
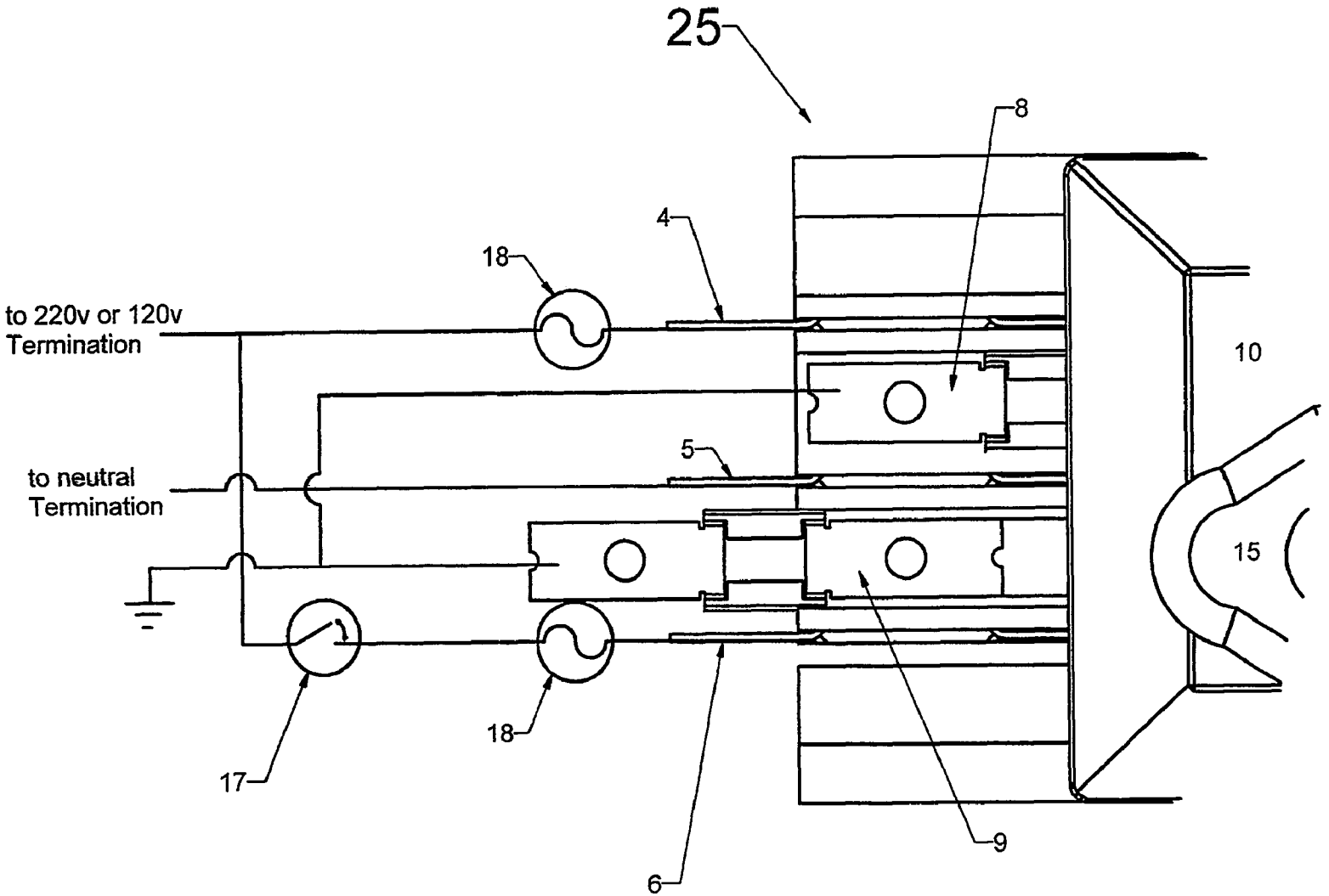
FIG. 2 is a front view of the bus bar of the circuit of the present invention, showing the bus bar terminations.

Reference is now made to FIG. 2 where, in particular, the bus bar system 25 is shown in detail. As mentioned above the bus bar system comprises two live buses, a neutral bus and two ground buses. The upper live bus 4 is connected through a current limiting device 18 to standard wiring that extends to a termination or fuse box within a building, where the termination or fuse box is connected to an AC power source. The voltage of the live bus 4 in some forms will be 230 Volts, but in others, such as when in use in a United States (US) power system it may be 120 Volts or any other appropriate voltage. The current limiting device 18 may be a circuit breaker, surge protector, fuse, ground fault circuit interrupter or any other appropriate device. The centre bus (lying between the two live buses) is the neutral bus 5. The neutral bus is also connected to standard wiring and to the termination or fuse box of the building (the termination or fuse box ultimately being connected to an electrical power distribution system). The lower live bus is a switched bus 6 and is connected through a current limiting device 18 to wiring and then to one side of a switch 17. The switch 17 is a standard switch or dimmer switch that is disposed in a building wall in a known manner. The other side of the switch 17 is connected via standard wiring to the "live" terminal in the termination or fuse box. Finally, the ground buses 8 and 9 are connected to a ground terminal. This ground terminal is usually located within the termination or fuse box, but may be located elsewhere.

Figure 3:
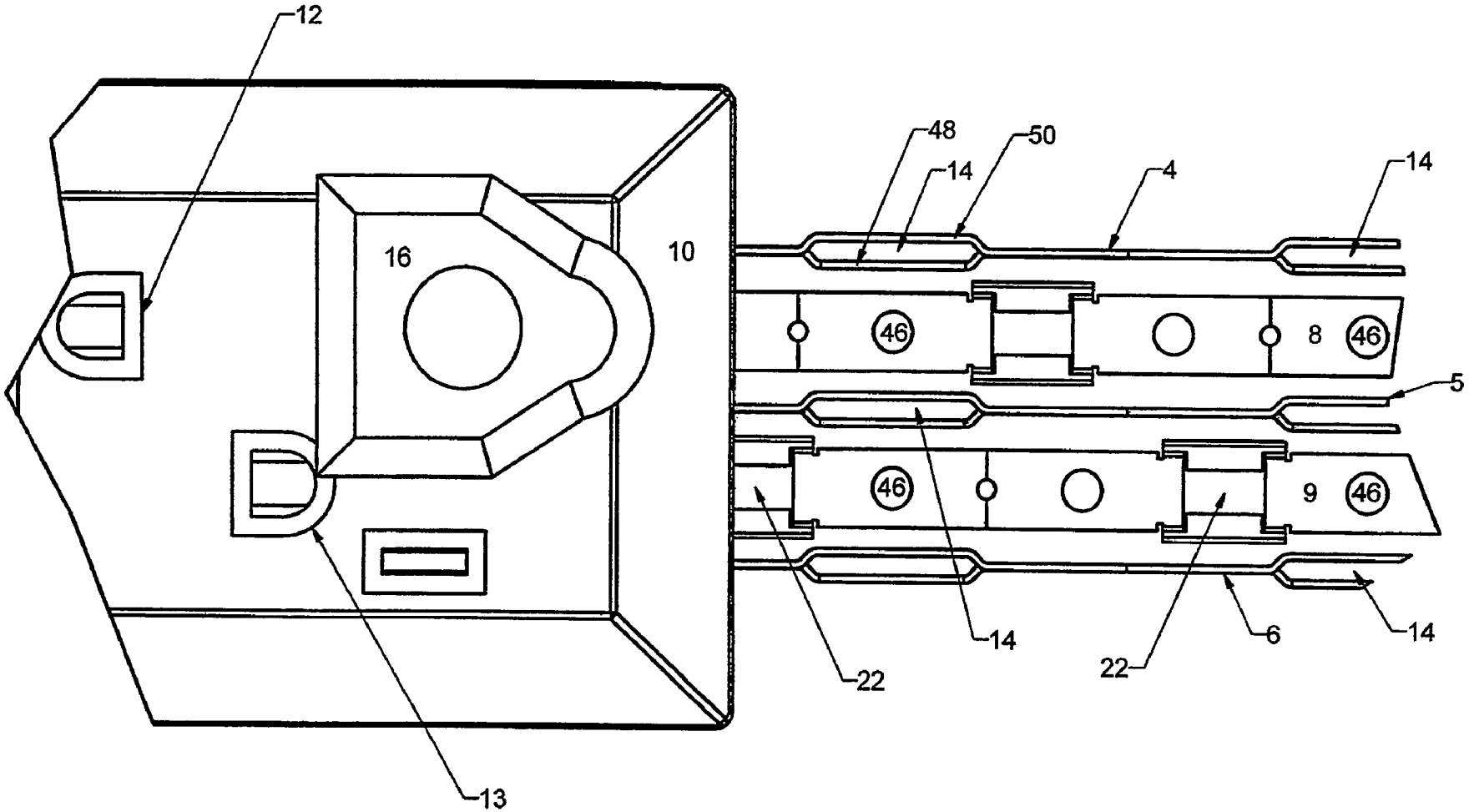
FIG. 3 is an alternative front view of the bus bar of the circuit, in particular showing the configuration of the bus bars and slots in which the pins of electrical plugs fit into.
Figure 10:
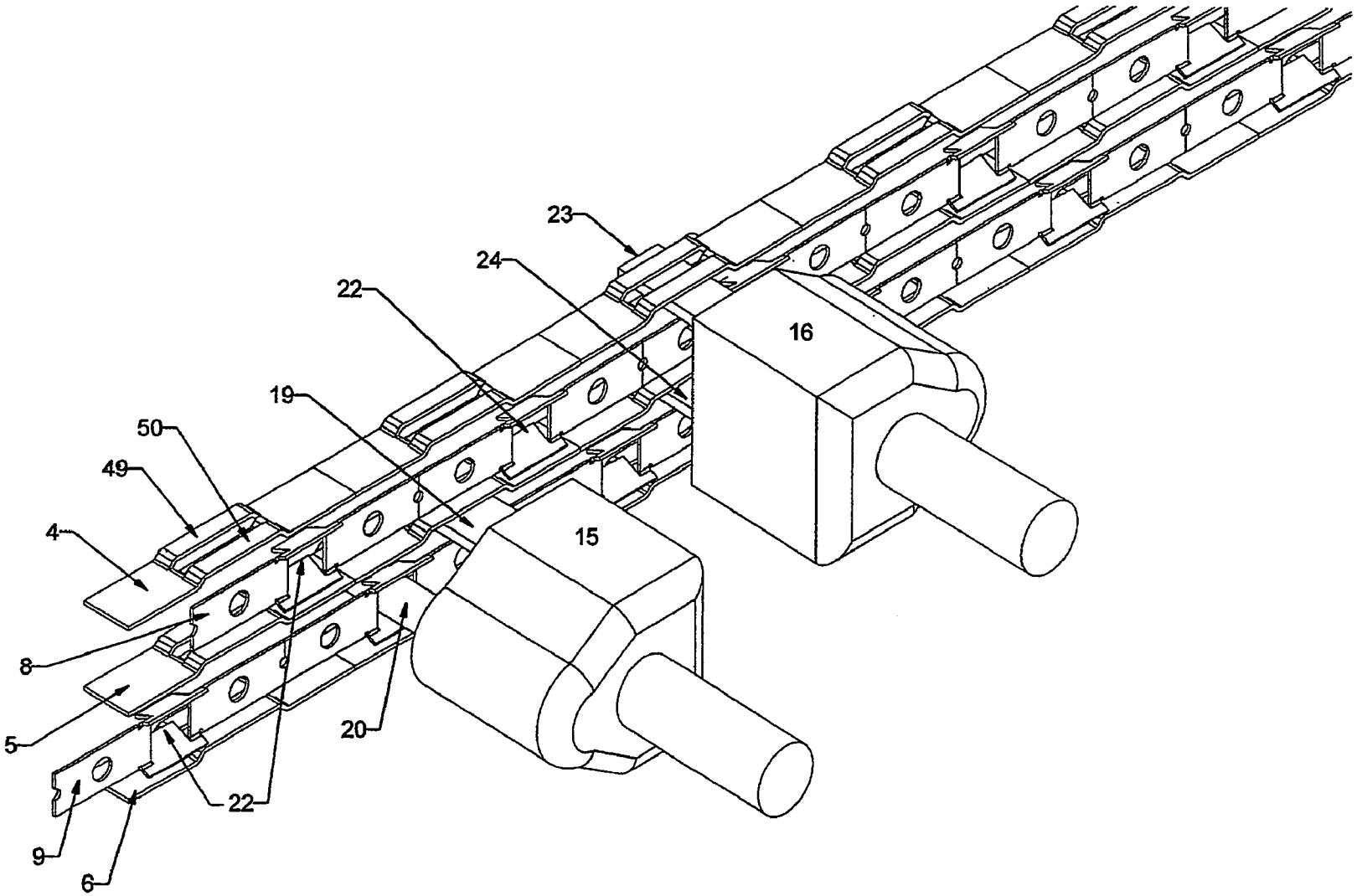
FIG. 10 is an illustration of two appliance plugs fitted into the bus bars of the first form of the circuit of the present invention.

Referring now to FIGS. 3 and 10, each of the bus bars 4, 5, and 6 is configured at intervals with receiving means. The receiving means are slots 14, which are integrally formed in each bus bar. Each slot 14 is of a shape to receive a pin of a plug connected to a load or electrical appliance. The slots 14 are shaped to form a tight connection between the bus bar and the pin of the plug. The slots 14 are spaced incrementally along the length of each of the buses in order to allow for incremental relocation of the back plate 11 and faceplate 10 along the bus bar system. The slots 14 in the bus bars are preferably formed integrally in the bus bar by the incremental punching of the slots in the bus bar, but the slots may be formed by other appropriate ways. In the preferred form, each slot 14 is formed when a central section 48 of the bus bar is pushed downwards out of the plane of the bus bar, thereby forming a trough, and the side sections 49, 50 of the bus bar are pushed upwards out of the plane of the bus bar, forming two upper inverted troughs on either side of the central section. In use, when a plug is inserted in the receptacle (front plate 10 and back plate 11) and the pins from the plug extend through the receptacle into the slots 14 on the bus bar, for each slot and respective pin, the central section 48 lies below the pin and the side sections 49, 50 lie above the pin and a tight fit is formed about the pin, creating a electrical contact between the pin and bus bar.

In some forms of the present invention, a plug may be utilized that has three pins. A standard electrical plug 15 is shown in FIG. 1. In most forms such a plug has three pins, but in some forms may only have two pins. The first two pins 19, 21 are flat pins extending from the plug 15 along parallel axes. The third pin 20 can be circular in shape, or may be of similar shape to the first two pins, but usually the third pin 20 extends from the plug along an axis parallel but between the first two pins 19, 21.

Referring to the form of the three pin US type plug as shown in FIG. 1, in use, when the plugs are inserted in a socket formed in the receptacle, the first pin 19 is connected the neutral bus 5 and second pin 21 may either be connected to the live bus bar 4 or switched bus bar 6. The third pin 20 is connected to one of the ground bus bars 8, 9 by way of a ground slot 22 in FIG. 3. Incrementally spaced ground slots 22 are formed in the ground bus bars. The ground slots 22 are similar to the slots 14 in the other bus bars, but in this form of the present the ground slots 22 are shaped to receive the third pin 20 of a standard US type plug. In other forms of the present invention the ground slots 22 and the slots 14 can be identical.

Referring again to FIG. 6, the protrusions 26 in the back plate 11 and apertures 12, 13 in the faceplate 10 form at least two sockets, one being a switched socket and the other a live socket. However, more than two sockets can be formed on the faceplate 10, for example, in FIG. 1, the faceplate has four sockets disposed within it, although in this form only two plugs are able to be received at one time within the sockets.

FIG. 10 shows the bus bars 4, 5, 6, 8, 9 and two plugs 15, 16. Plug 15 is in a position within the bus bars which cause the appliance attached to the plug to be "switched". When a user operates the switch 17 (as shown schematically in FIG. 2) the appliance can be switched on or off. When a plug is inserted in the "switched socket" the first pin 19 resides within a slot 14 in the neutral bus 5. The second pin 21 (not shown in FIG. 10, but being disposed below pin 19) resides within an aperture in the switched bus 6. The ground pin 20 resides within the slot 22 in the lower ground bus 9. Plug 16 is in a position within the bus bars which cause the appliance attached to the plug to be continuously powered or live. When a plug is inserted in the "live socket" the first (upper) pin 23 resides within an aperture in the live bus 4. The second (lower) pin 24 resides within a slot 14 in the neutral bus 5 and the ground pin (not shown in this view) resides within a slot 22 in the upper ground bus 8.

The construction of the circuit of the present invention will now be described with reference to FIGS. 4 to 6. As already discussed, the bus bar system 25 (consisting of the bus bar insulator 7 and bus bars 4, 5, 6, 8, and 9) resides within a housing 2 where the housing is located on a wall within a building. FIG. 5 shows the end view of the bus bar insulator 7. The bus bar insulator has three hollow channels 43 to enclose the live, neutral, and switched buses. A continuous open slot 44 is incorporated at one side of these channels to allow the electric plug pins to extend through the apertures in the bus bars. FIG. 5A is an isometric view of the bus bar 7 and shows the incrementally spaced openings 45 for the ground bus slots 22 (as described earlier with reference to FIG. 3). As shown in FIG. 6, the back plate 11 is attached to the upper 28 and lower 29 faces of the housing 2 by appropriate means. In the preferred form of the invention, the back plate 11 is indexed laterally by a boss (not shown) on the back of the back plate 11. This boss protrudes through incrementally spaced holes 46 (FIG. 3) in the ground buses 8, 9 and then through the back plate locator hole 47 (FIG. 5A). The back plate 11 is then screwed to the housing 2 using screws 27. FIG. 5B shows the complete bus bar system 25 with all buses installed in the bus bar insulator. The remainder of the bus bar and housing that is not covered by the back plate 11 is then covered by a cover 30 (FIGS. 6, 7) formed from a plastics type material and cut to the appropriate length.

In FIG. 6 the faceplate 10 is illustrated as having a number of notches 32 that lock with complementary protrusions 31 formed in the back plate edges. When the faceplate is snapped over the back plate, the apertures 12, 13 of the faceplate 10 are aligned with the complimentary protrusions 26 of the back plate, so that when the plugs 15, 16 (see FIG. 1) are inserted into these sockets, the pins extend through the faceplate 10, back plate 11, open slots 44 of bus bar insulator 7, and then into the slots within the bus bars.

Figure 4:
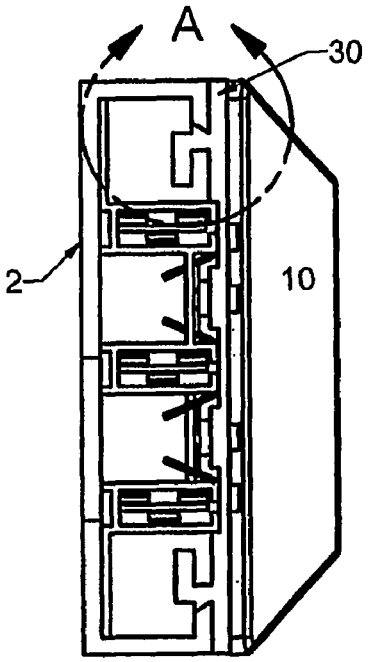
FIG. 4 is a side view of the bus bar, bus bar housing and receptacle of the present invention.
Figure 4A:
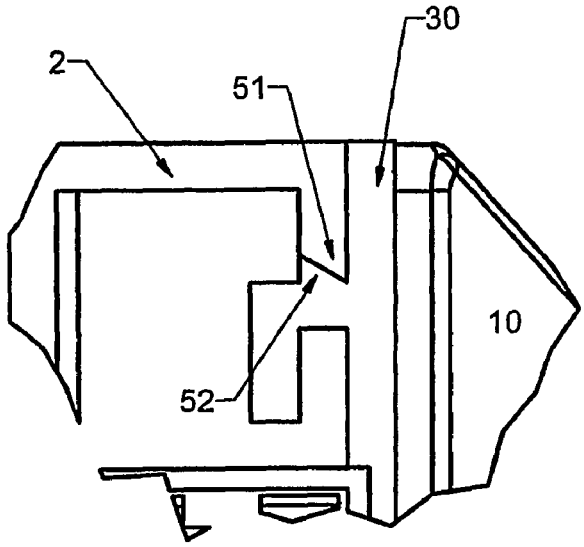
FIG. 4A is a close-up view of detail A of FIG. 4 showing the interconnection between the bus bar housing, back plate and faceplate of the receptacle.
Figure 4B:
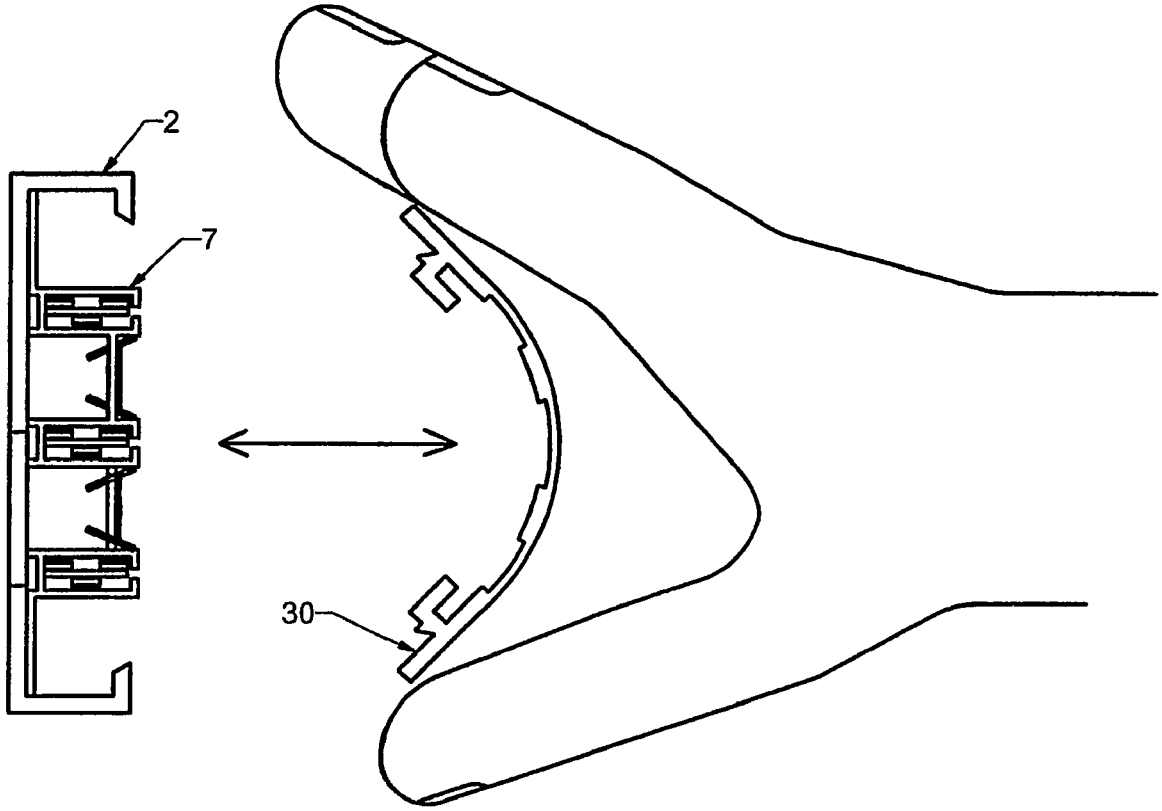
FIG. 4B is an illustration of the installation or removal of the bus bar cover of the present invention.
Figure 5A:
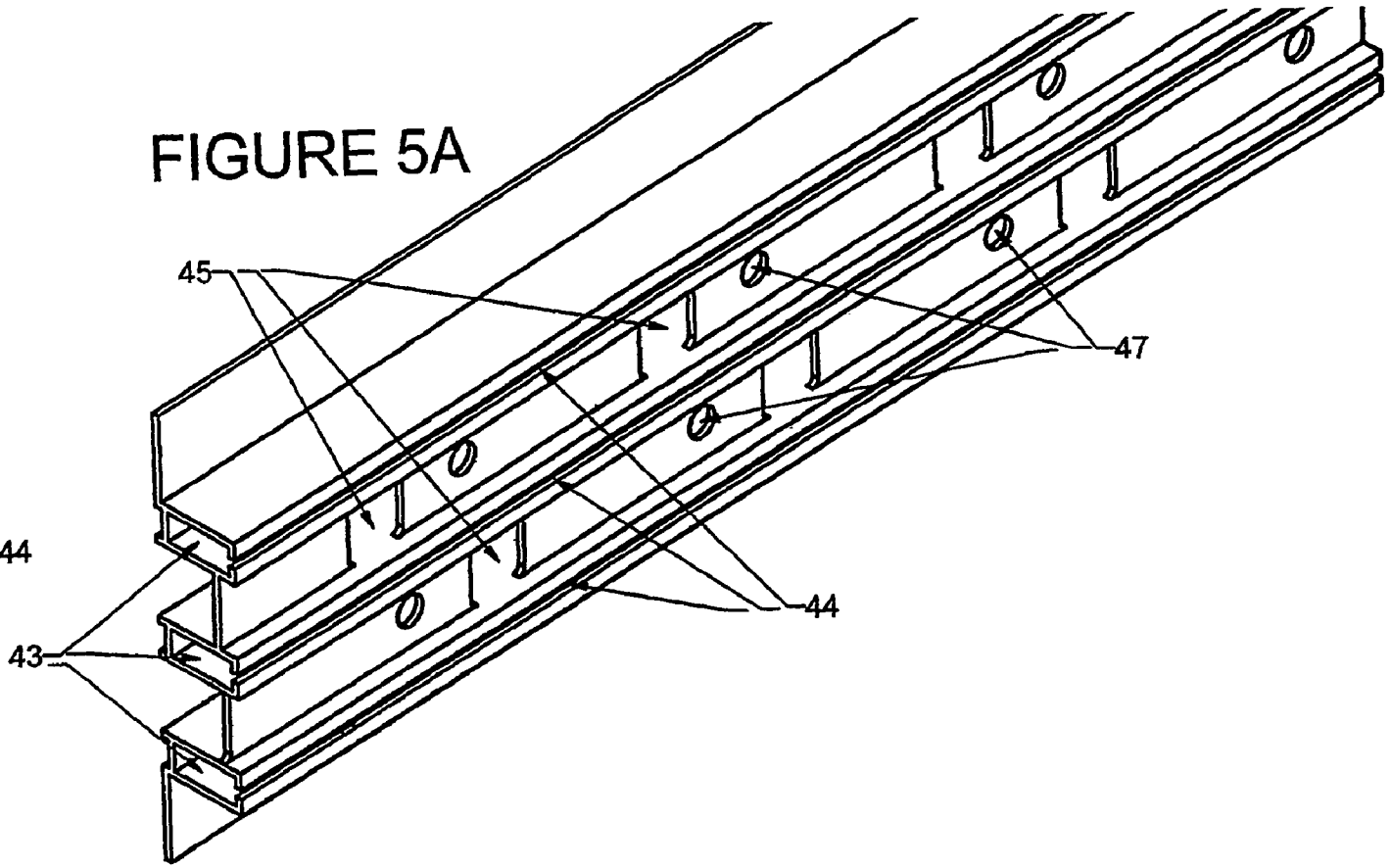
FIG. 5A is an isometric view of the bus bar insulator.
Figure 5:
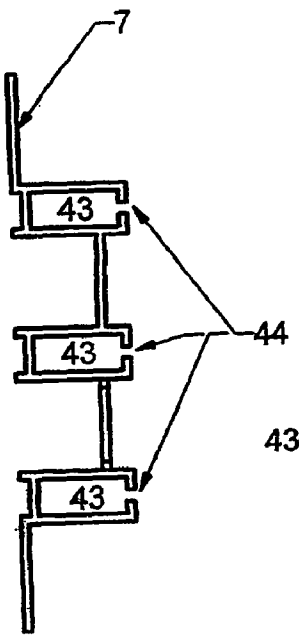
FIG. 5 is an end view of the bus bar insulator used with the circuit of the present invention in order to insulate the bus bars.
Figure 5B:
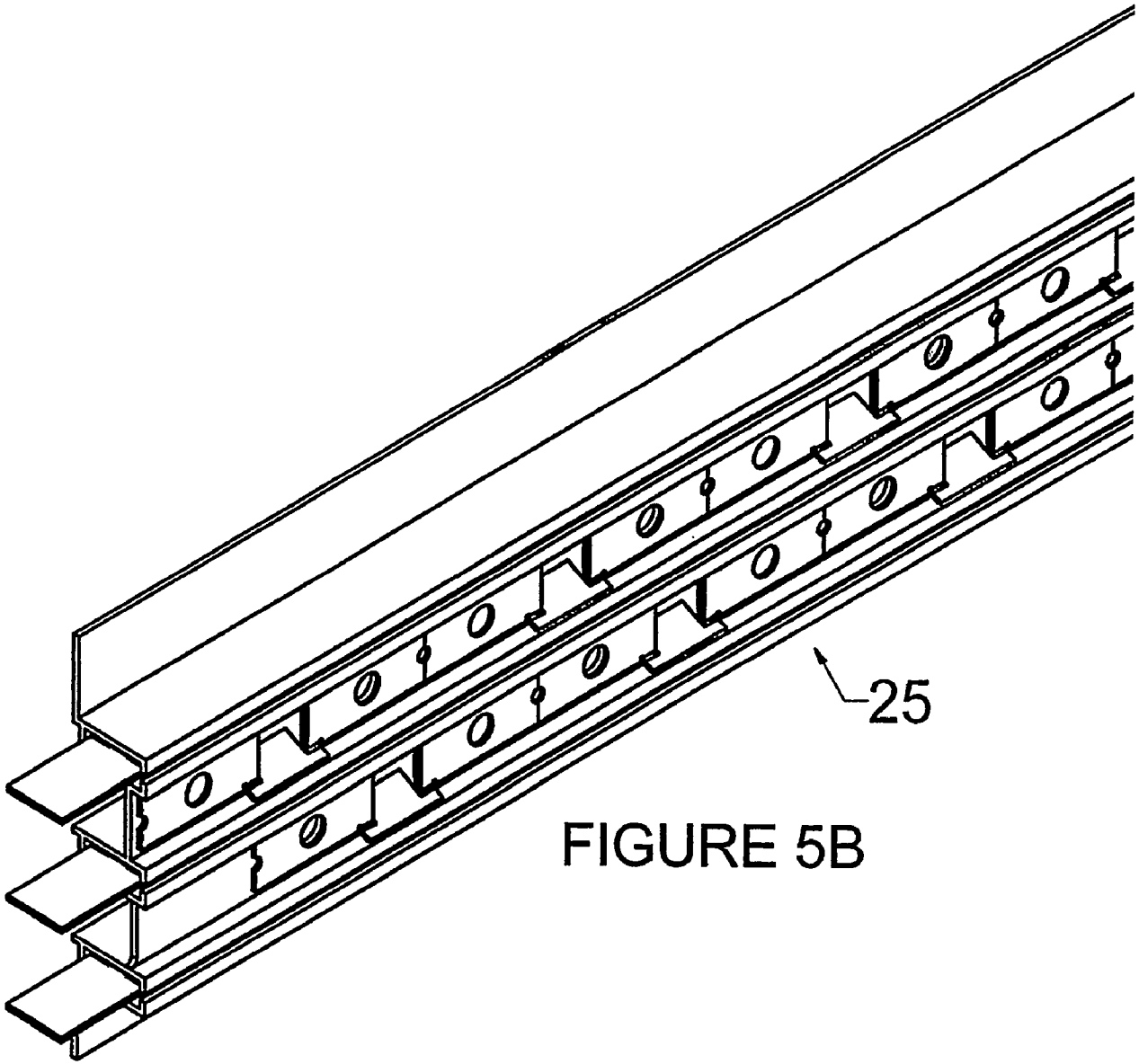
FIG. 5B is an isometric view of the bus bar insulator with the bus bars installed.

FIGS. 4, 4A and 4B show side views of the circuit. FIG. 4A shows a protrusion 51 at the edges of the housing 2 locking with a corresponding protrusion 52 in cover 30. FIG. 4B illustrates the installation and removal of the cover 30, which is achieved by squeezing and bending the cover 30 in order for the protrusion 52 on the cover 30 to fit into the protrusions 51 and into the housing, to cover the exposed parts of the bus bar system. Other means to achieve the attaching of the cover to the housing are envisaged, such as, sliding the cover over the housing.

Figures 7, 7A:
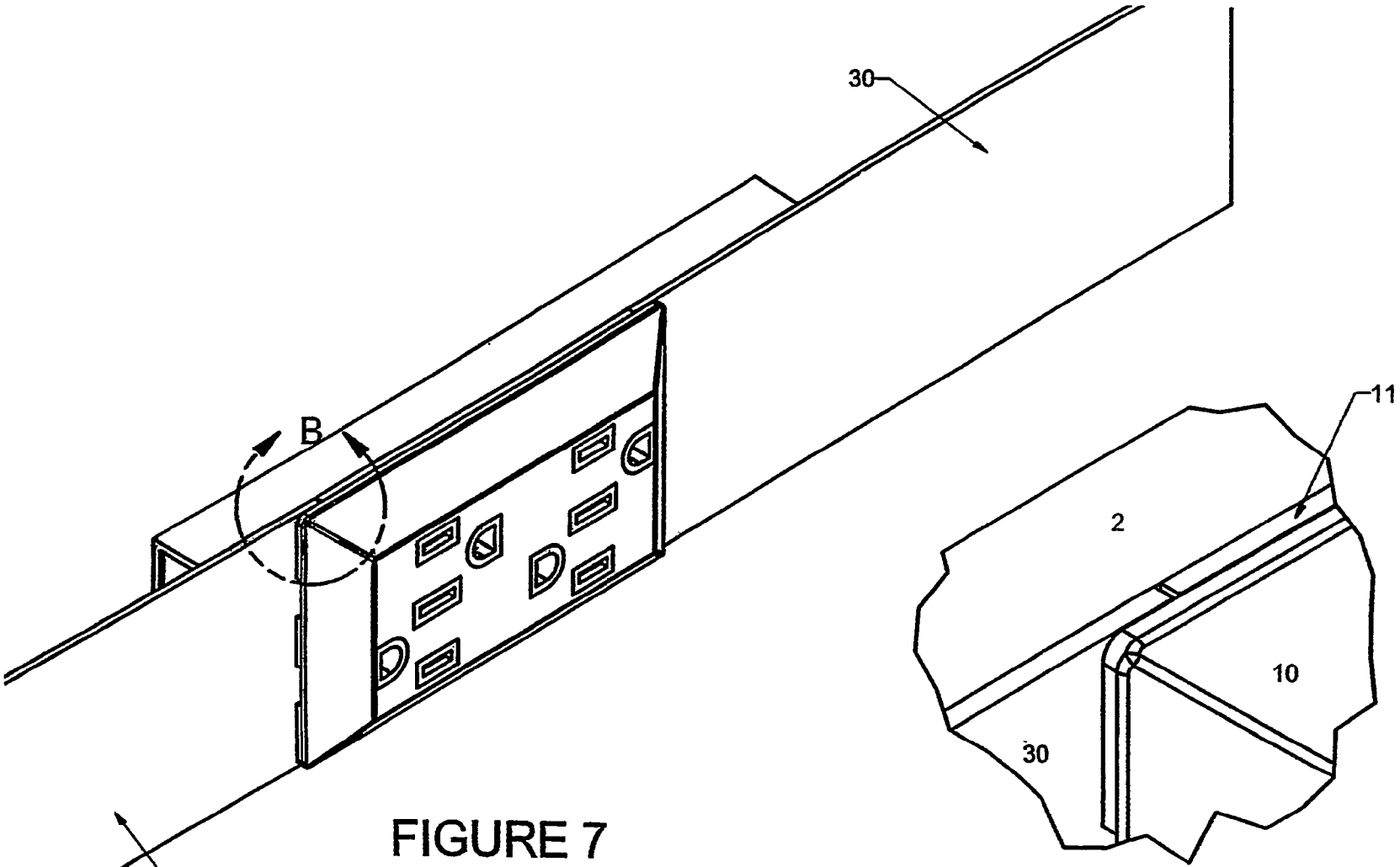
FIG. 7 is an illustration of the circuit of the present invention fully assembled.
FIG. 7A is a close-up illustration of detail B of the circuit as shown in FIG. 7.

When the receptacle (faceplate 10 and back plate 11) is completely installed as shown in FIGS. 7 and 7A, the gaps between the cover 30 and back plate 11 are covered by the ends of faceplate 10 thus providing for a safe and secure connection of the receptacle to the housing.

In order to move the faceplate 10 to a different position along the bus bar the faceplate 10 must be removed (for example, snapped off using a standard flat blade screwdriver or similar tool) and the back plate 11 unscrewed and removed from the housing 2. The covers 30 then can be removed as described above referring to FIG. 4B and the back plate relocated to a new desired location. The back plate is then resecured to the housing 2 using screws 27 and the replacement covers cut to appropriate lengths are reinstalled to cover the exposed bus bar system and housing. Finally the faceplate 10 is reinstalled (snapped) onto the relocated back plate 11.

A number of back plates can permanently reside at appropriate locations along the bus bar therefore faceplates can be installed over the back plates at a number of points along the bus bar.

Figure 8:
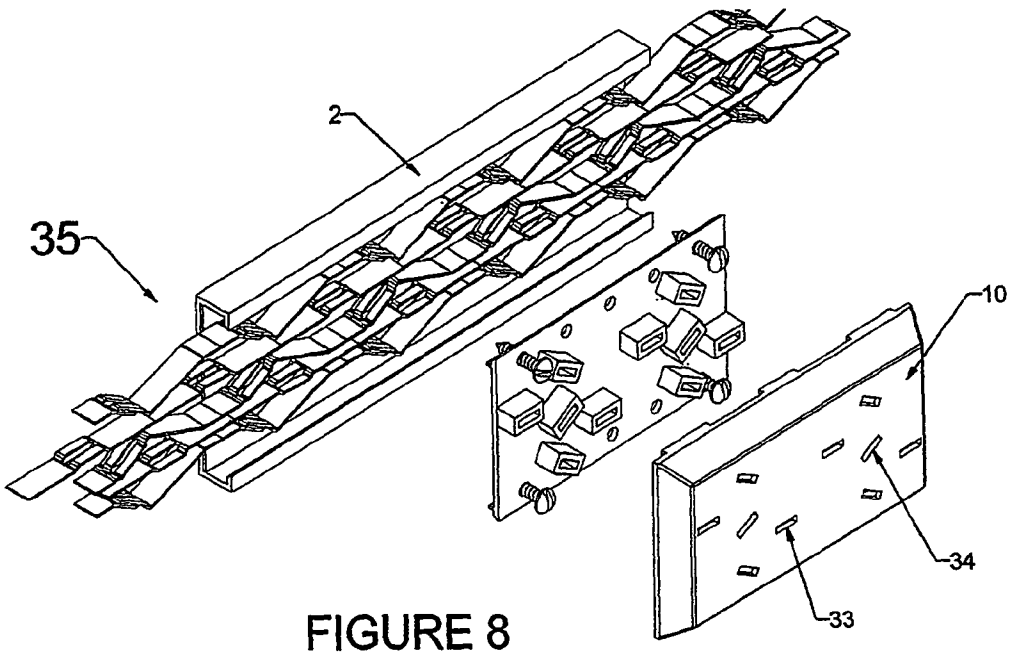
FIG. 8 is an illustration of an alternative bus bar and receptacle suitable for the New Zealand power system.
Figure 9:
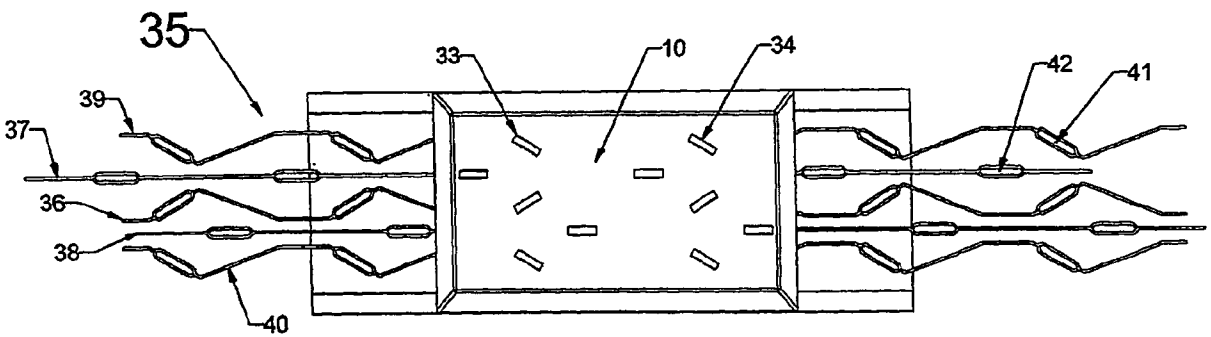
FIG. 9 is a plan view of the alternative bus bar and receptacle as shown in FIG. 8.

FIGS. 8 and 9 show an alternative form of the bus system of the present invention. This form is more appropriate for a power system within New Zealand. In this form the bus system 35 is arranged in a different manner so that the bus bars and sockets 33, 34 are able to accommodate the New Zealand style plugs and pins. In this form the upper bus bar 39 is the live bus bar and the lower bus bar 40 is the switched bus bar. The centre bus bar 36 is the neutral bus bar and the bus bars above and below the neutral bus bar 36 are the ground buses 37, 38. In this form the slots in the live, switched and neutral bus bars 41 are of the same configuration as the slots 42 in the ground bus bar, in order to accommodate the pins of a New Zealand style plug. This form of the electrical outlet of the present invention is constructed and operates in the same manner as is described above.

In other forms of the present invention a channel may be provided along the bottom of the housing 2 for the passage of telecommunications lines, such as a phone line or Internet line (CAT 5). The telecommunications line would preferably terminate at a socket formed in the faceplate, the socket would be of the type in which electronic equipment such as computers or telephones could be plugged into.

As already mentioned, the housing and bus bars extend along the length of walls within a building. In order to facilitate the extension of the bus bars around corners of the walls a number of clips are provided within the bus bar system that accept the rectangular end of the bus bars on one side and at the other side are attached to standard bendable wiring that extends around a corner and connects back into a second clip. The other side of the second clip is connected to a further rectangular end of the bus bar and the length of the bus bar extends along the length of a second wall. An alternate method of extending the continuity of the bus bars around corners is to utilize standard solder joints with wires.

As the faceplate is positionable at any number of different locations along the bus bar, the need for extension cords is minimized or eliminated. This provides a less cluttered room appearance and reduces the likelihood of tripping over or damaging extension cords. Furthermore, fire and other safety hazards are minimized. In comparison to a conventional electrical outlet embedded in a wall, it is very easy to change the location of the receptacle of the present invention and this can be accomplished with a minimum number of standard tools very quickly (time from start to finish should average less than 10 minutes). Also, the addition of new receptacles can be accomplished just as easily. Usually, changing the location of a conventional electrical outlet typically requires removing the drywall surrounding the outlet, removing the drywall surrounding the desired new location, securing the outlet to an internal beam or structure of the wall at the new location, extending the electrical wires (within the wall) to which the outlet is connected, and applying new drywall or filler at the old and new locations of the outlet.

The faceplate and back plate, forming the receptacle, can be configured to receive any desired number of plugs for different electrical appliances (or electrical plugs). With redesign for different plug types, the basic concept of this apparatus can be adopted to any electrical system worldwide. Furthermore, the receptacle can be configured to receive different types of connectors, such as connectors for telephone wires, coaxial wires for cable television and/or cable modems, OSL wires, fiber optics, and the like (this would allow these connections to be relocated just as easily as the electric power outlets).

The receptacle of the present invention also provides a user with both a switched power socket and a continuously live power socket thus offering more versatility in placement of appliances and or lamps.

Figure 11:
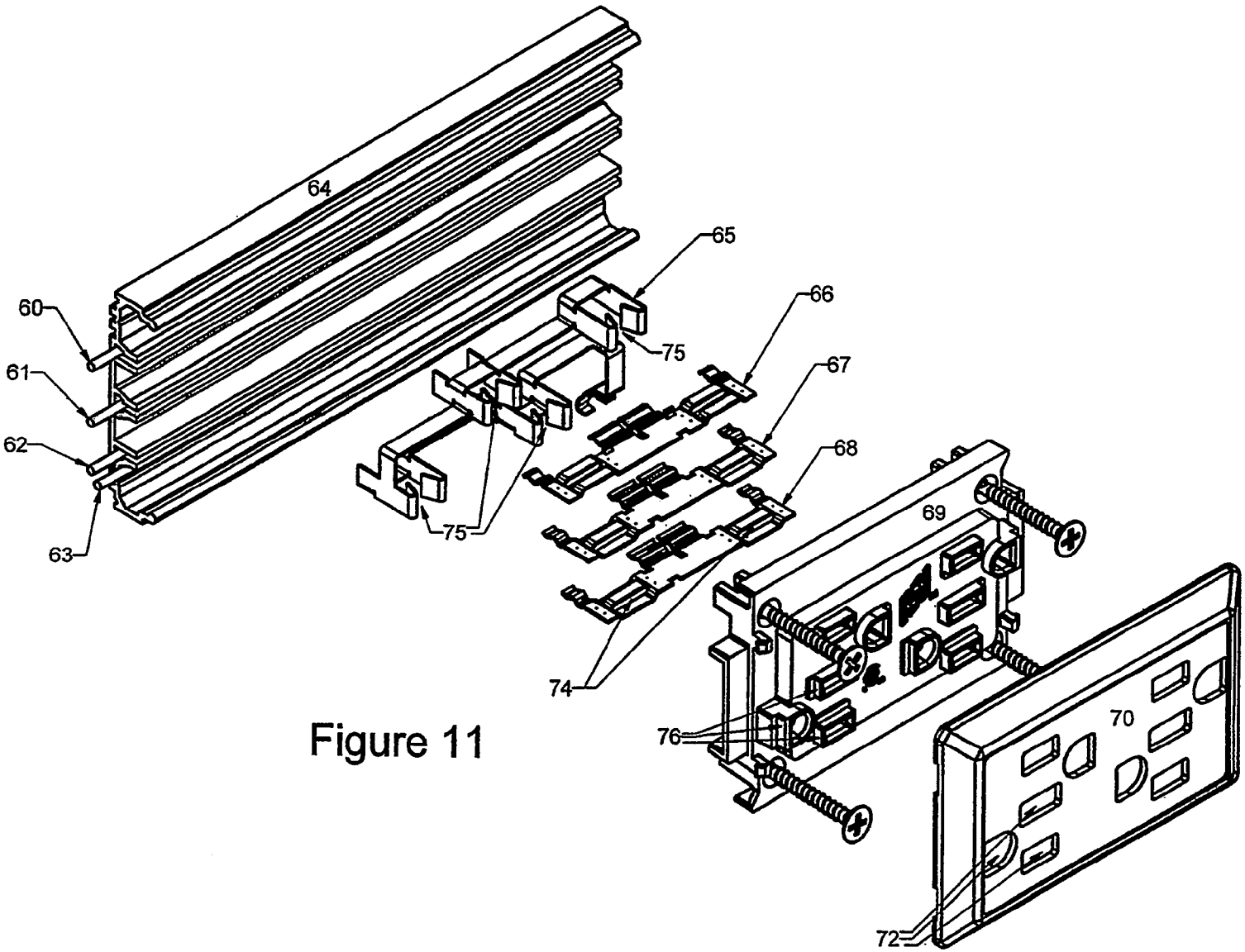
FIG. 11 is an exploded view of an alternative embodiment of the circuit of the present invention where a plurality of wires provide electrical power to terminals connected to a receptacle that provides both switched and continuously powered electrical sockets.

Referring now to FIGS. 11 to 15, an alternative embodiment of the circuit of the present invention will be described where a plurality of wires 60, 61, 62, 63 provide electrical power to terminals 65, 66, 67, 68 connected to a receptacle (69 and 70) that provides both switched and continuously powered electrical sockets. In this form of the circuit of the present invention an elongated recess 64 is provided that houses the plurality of wires 60, 61, 62, 63. In particular, as shown in FIG. 11, the extruded housing is made from a plastics material and houses four wires, a switched wire 60, one that can be made live by the operation of a switch, neutral wire 61, continuously ("live") wire 62 and ground wire 63. Each of these wires is connected to a termination or fuse box of a building, whether by way of standard wiring or directly to the box. A receptacle comprising a faceplate 70 and back plate 69 and a plurality of terminals 65, 66, 67, 68 is fittable to the elongated recess (extruded housing) 64 in the same manner as described above in relation to FIG. 6.

Located behind the back plate 69 are a plurality of terminals 65, 66, 67, 68. In particular, each of these terminals relate to a particular one of the wires within the housing 64. Therefore, there is a ground contact terminal 65, switched contact terminal 66, neutral contact terminal 67 and continuously powered ("live") contact terminal 68. Each of these terminals has receiving means or slots 74, 75 that are able to receive a plug 77, 78, 79 of an electrical plug 73 connected to an electrical appliance. As an example, the slots in the switched 66, neutral 67 and live 68 terminals preferably receive one of the two narrow pins 77, 78 (similar to those pins 19, 21 described in relation to FIG. 1) of the plug 73. The ground terminal 65 has a slot 75 that is capable of receiving the larger pin 79 of the plug 73. Each of the terminals is fixed to the back plate 69 and is arranged such that when the receptacle is fitted to the housing 64 part of each terminal abuts the corresponding wire.

The faceplate 70 has apertures 72 and the back plate 69 has complimentary protrusions 76 that form a channel through the receptacle, such that at least a switched and a continuously powered socket are provided on the receptacle. As with the embodiment described above, the switched socket can be operated by a switch and the other is continuously live. An electrical appliance plug 73 has pins 77, 78, 79 that are fittable through each channel so that when fitted into a socket the pins extend and abut the terminals 65, 66, 67, 68. In this manner, the plug 73 may be plugged into one of the two sockets on the receptacle and each of the pins connect with a particular terminal, much in the same manner as discussed above in relation to FIG. 10, to form either a switched connection or continuously powered connection.

Figure 12:
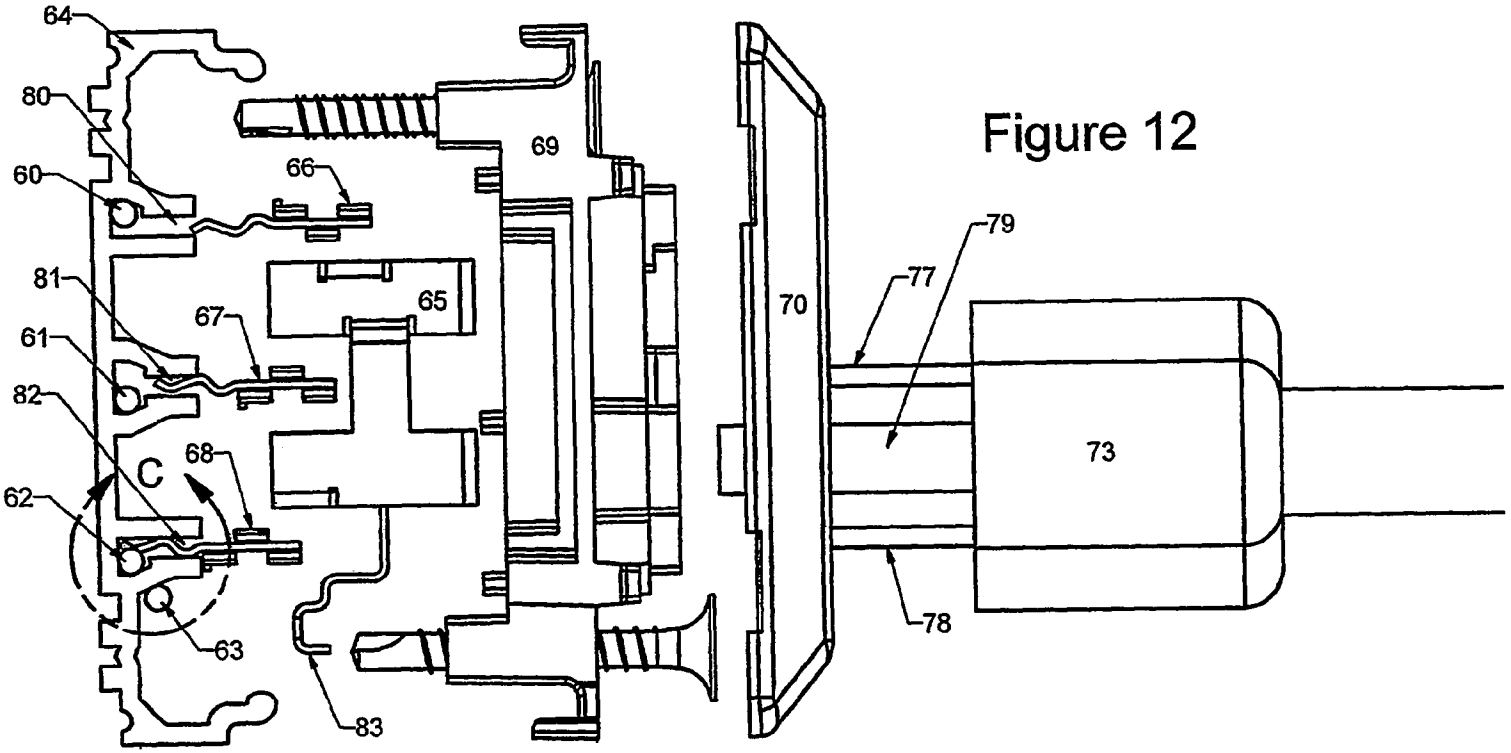
FIG. 12 is a side view of the alternative embodiment of FIG. 11.
Figure 13:
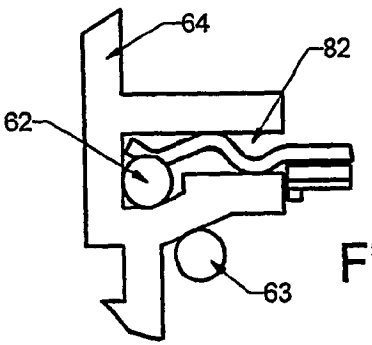
FIG. 13 is a close-up view of detail C of FIG. 12.

Referring now to FIGS. 12 and 13, each of the terminals 66, 67, 68 has an extension that is formed such that side on it has a waved profile. The waved extensions are fitted through apertures 80, 81, 82 formed in the elongated housing 64 and the end of the extensions of the contact terminals abuts the wires housed within the apertures 80, 81, 82 of the housing 64. A firm connection is made due to the spring tension in each of the waved extensions causing the ends of the extensions to push down on each wire, as shown in FIG. 13.

Figure 14:
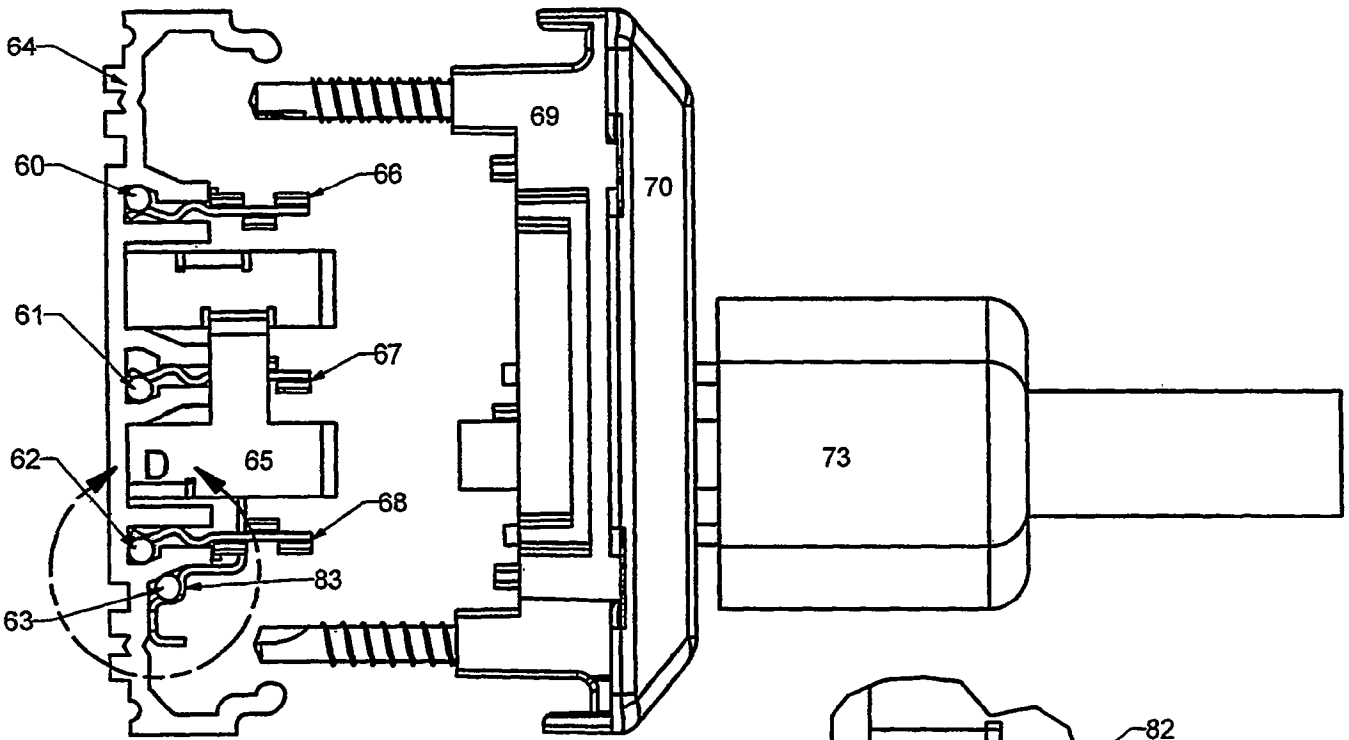
FIG. 14 is a further side view of the circuit of FIG. 11 showing the seating of the live and ground wires against their respective contacts.
Figure 15:
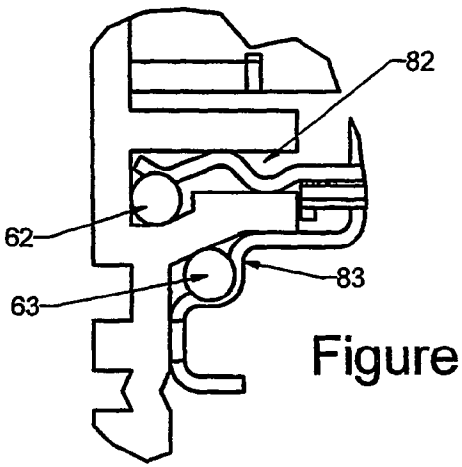
FIG. 15 is a close-up view of detail D of FIG. 14.

Referring now to FIGS. 14 and 15, the ground contact terminal 65 has an extension 83 that extends below the main body of the terminal 65 to contact the ground wire 63.

The receptacle and wiring system of this embodiment of the circuit of the present invention allows for the receptacle to be moved along the recess 64 and placed at an infinite number of positions along the recess 64, thus giving the user flexibility in the choice of locations of the receptacle and subsequently sockets. This form of the present invention provides advantages over the form described above in relation to FIG. 1. The bus bar system of FIG. 1 only allows for set positioning of the receptacle over the slots formed in the bus bars. In this alternate embodiment the receptacle can be slid along the recess 64 and the contact terminals 65 to 68 will merely slide along the wires 60 to 63. Also the problem of continuing the electrical continuity around corners using the bus bar system is eliminated since the wires 60 to 63 can simply be bent around corners.

Figure 17:
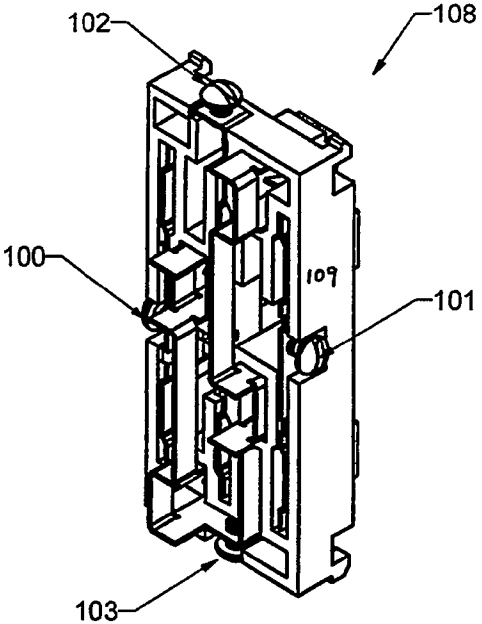
FIG. 17 is a rear perspective view of the stand-alone circuit of FIG. 16.
Figure 16:
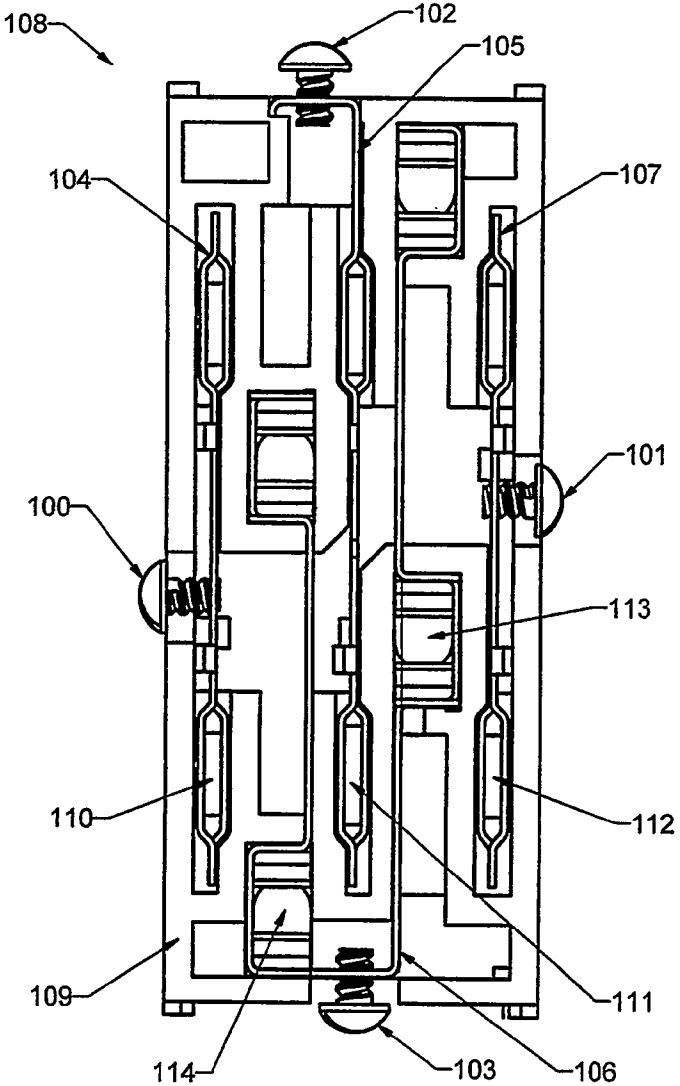
FIG. 16 is a plan view of a stand-alone embodiment of a circuit of the present invention.

A stand-alone circuit is shown in FIGS. 16 and 17. This circuit would be suitable to replace existing stand-alone power sockets. Here a receptacle 108 has a face plate (not shown) and back plate 109. Terminals 104, 105, 106, 107 (similar to those described above) reside in the back of the back plate 109. The terminals have slots 110, 111, 112, 113,114 that are capable of receiving the pins of a standard 2 or 3 pin plug to allow for an electrical connection to be made to the plug. Each of the terminals is connected via screws 100, 101, 102, 103 to standard wiring in a house or building and to a termination or fuse box. The terminals are of much the same form as described above in relation to FIG. 11 and provide for both a switched power socket and a continuously live electrical power socket.

We claim:

1. A low voltage electricity distribution circuit, which supplies both switchable and unswitchable power from switchable and unswitchable power sources, comprising:

a molding defining a recess;

a plurality of conductors configured to receive pins of a plug that is electrically connected to an electrical load, comprising:

a first conductor electrically connected to an unswitchable power source;

a second conductor electrically connected to a switchable power source; and a third conductor electrically connected to a neutral power source; and at least one receptacle mechanically and releasably engaged with the molding, wherein the receptacle includes at least one live socket and one switchable socket, each socket formed by a plurality of apertures extending through the receptacle and connected to the conductors;

wherein when the plug is inserted in the live socket the pins form an electrical connection with the first conductor and the third conductor such that the electrical load is continuously powered, and when the plug is inserted in the switchable socket the pins form an electrical connection with the second conductor and the third conductor such that the electrical load is switchably powered.

2. The low voltage electricity distribution circuit of claim 1, wherein at least one of the apertures in use is shared by the live socket and the switchable socket.

3. The low voltage electricity distribution circuit of claim 1, wherein the molding is elongated and the recess extends substantially continuously along the molding.

4. The low voltage electricity distribution circuit of claim 1, wherein the first conductor, the second conductor and the third conductor together form a busbar system.

5. The low voltage electricity distribution circuit of claim 1, wherein the first conductor, the second conductor and the third conductor are each an electrical wire housed within the recess.

6. The low voltage electricity distribution circuit of claim 1, further comprising:

a channel for housing at least one telecommunications line in the recess;

a telecommunication line housed in the channel; and a telecommunication line socket in the receptacle connected to the telecommunication line in the channel.

7. An electrical distribution system which supplies both switchable and unswitchable power from switchable and unswitchable power sources, comprising:

a first conductor that is connected in use to the unswitchable power source;

a second conductor that is connected in use to the switchable power source;

a third conductor that is connected in use to a neutral power source; and a receptacle for receiving one or more electrical plugs, comprising:

a face plate;

a first aperture extending through the face plate and providing access to the first conductor;

a second aperture extending through the face plate and providing access to the second conductor; and a third aperture extending through the face plate and providing access to the third conductor;

wherein the first and third apertures define an unswitchable socket configured to receive pins of an electrical plug, and the second and third apertures define a switchable socket configured to receive the pins of the electrical plug.

8. The electrical distribution system of claim 7, wherein the receptacle includes one or more additional unswitchable sockets.

9. The electrical distribution system of claim 7, wherein the receptacle includes one or more additional switchable sockets.

10. An electrical distribution system which supplies unswitchable power from an unswitchable power source, comprising:

a first conductor that is connected in use to the unswitchable power source;

a second conductor that is connected in use to the unswitchable power source; and a third conductor that is connected in use to a neutral power source;

a receptacle for receiving one or more electrical plugs, comprising:

a face plate;

a first aperture extending through the face plate and providing access to the first conductor;

a second aperture extending through the face plate and providing access to the second conductor; and a third aperture extending through the face plate and providing access to the third conductor;

wherein the first and third apertures define a first unswitchable socket configured to receive pins of an electrical plug, and the second and third apertures define a second unswitchable socket configured to receive the pins of the electrical plug, the receptacle being configured to be releasably engaged with the first, second, and third conductors.

11. An electrical distribution system which supplies switchable power, comprising:

a first switchable power source;

a second switchable power source;

a first conductor that is connected in use to the first switchable power source;

a second conductor that is connected in use to the second switchable power source; and a third conductor that is connected in use to a neutral power source;

a receptacle for receiving one or more electrical plugs, comprising:

a face plate;

a first aperture extending through the face plate and providing access to the first conductor;

a second aperture extending through the face plate and providing access to the second conductor; and a third aperture extending through the face plate and providing access to the third conductor;

wherein the first and third apertures define a first switchable socket configured to receive pins of an electrical plug, and the second and third apertures define a second switchable socket configured to receive the pins of the electrical plug, the receptacle being configured to be releasably engaged with the first, second, and third conductors.

12. The electrical distribution system of claim 11, wherein the first switchable power source and the second switchable power source are connected to a common switch.

13. The low voltage electricity distribution circuit of claim 1, wherein the receptacle can be placed in any one of a plurality of locations along the molding.

* * * * *